US008245322B1

(12) United States Patent
Bouza

(10) Patent No.: US 8,245,322 B1
(45) Date of Patent: Aug. 21, 2012

(54) WEIGHTED EXERCISE GARMENT WITH DETACHABLE SECTIONS

(75) Inventor: Kevin Bouza, Metairie, LA (US)

(73) Assignee: Athletic Training Innovations, LLC, Kenner, LA (US)

( * ) Notice: Subject to any disclaimer, the term of this patent is extended or adjusted under 35 U.S.C. 154(b) by 301 days.

(21) Appl. No.: 12/427,845

(22) Filed: Apr. 22, 2009

(51) Int. Cl.
*A41D 1/04* (2006.01)

(52) U.S. Cl. ..... 2/102; 2/94; 2/95; 2/126; 2/70; 2/72; 482/105

(58) Field of Classification Search ..... 2/102, 72, 2/86, 94, 126, 95, 70, 247, 250, 252; 482/105, 482/124
See application file for complete search history.

(56) References Cited

U.S. PATENT DOCUMENTS 4,006,495 A * 2/1977 Jones ..... 2/93
5,033,117 A 7/1991 Fairweather
5,553,322 A 9/1996 Cebo-Johnson
5,628,064 A * 5/1997 Chung ..... 2/70
5,652,961 A * 8/1997 Knight-Yurt ..... 2/114
5,943,700 A 8/1999 Hammer et al.
5,978,964 A 11/1999 Gaston
6,029,270 A * 2/2000 Ost et al. ..... 2/2.5
6,047,404 A * 4/2000 Blanks, I ..... 2/69
6,349,413 B1 2/2002 Rose et al.
6,473,904 B2 11/2002 Long
6,557,176 B2 * 5/2003 Franco-Sion ..... 2/102
7,376,979 B2 5/2008 Nilsen
2003/0092544 A1 * 5/2003 Reed ..... 482/105
2006/0090240 A1 * 5/2006 McKenzie et al. ..... 2/102

* cited by examiner

*Primary Examiner* — Alissa Tompkins
(74) *Attorney, Agent, or Firm* — Kenneth L. Tolar

(57) ABSTRACT

An exercise garment is formed of a pair of shorts and an accompanying vest which are worn by an exerciser to enhance strength, conditioning, power, endurance and agility. The shorts include a pelvic portion with a pair of leg sections depending therefrom. Each leg section terminates at a leg opening having a circumferential zipper strand adjacent thereto. Immediately above the zipper strand are a plurality of juxtaposed, segregated pockets for receiving a weighted bar. A leg extension having multiple weight pockets includes a peripheral zipper strand at an upper end for mating engagement with the zipper strand of either leg section allowing the effective length thereof to be increased. The accompanying vest is formed of a torso portion with a pair of separable sleeves extending therefrom. A plurality of weight pockets are positioned on the front and rear of the torso portion and each sleeve. A torso extension having multiple weight pockets is removably attachable to the lower edge of the torso portion. Comfort flaps are securable over all of the pockets to form a comfort-enhancing, weight-restraining barrier.

7 Claims, 3 Drawing Sheets

WEIGHTED EXERCISE GARMENT WITH DETACHABLE SECTIONS

CROSS REFERENCE TO RELATED APPLICATIONS

None.

BACKGROUND OF THE INVENTION

The present invention relates to a weighted garment with detachable sections for intensifying exercises.

DESCRIPTION OF THE PRIOR ART

Athletes and avid exercisers engage in various conditioning activities such as jogging, walking, aerobics, basketball and/or various underwater exercises. The benefits of weight-loading certain muscle groups while engaging in such activity, i.e., a form of resistance training, have been well documented. However, using free weights while exercising is cumbersome and impractical. Accordingly, there is currently a need for a device that loads target muscles during the performance of certain exercises.

A review of the prior art reveals a myriad of weighted garments and similar items. For example, U.S. Pat. No. 5,553,322 issued to Cebo-Johnson discloses a unitary, weighted exercise garment including an upper portion for overlaying the wearer's shoulders, a torso portion and a lower portion having leg portions depending therefrom. Weight-receiving pockets are positioned at various locations on the garment.

U.S. Pat. No. 5,033,117 issued to Fairweather discloses a unitary exercise garment including an upper portion with a pair of thigh portions depending therefrom. Weight pockets on each thigh portion allow a wearer to weight-load the thighs.

U.S. Pat. No. 7,376,979 issued to Nilsen discloses an exercise garment comprising a trouser portion and a shirt portion each having varying-configured weight pockets positioned thereon.

U.S. Pat. No. 5,978,964 issued to Gaston discloses exercise apparel such as a jersey and shorts each having a plurality of tubular pockets thereon for receiving cylindrical weights.

U.S. Pat. No. 5,943,700 issued to Hammer et al. discloses a weighted vest formed of two halves interconnected with a pair of straps. Each half of the vest includes pockets for receiving weights.

U.S. Pat. No. 6,473,904 issued to Long discloses a scuba-diving wetsuit having detachable sleeve and leg sections allowing a diver to alter the suit configuration according to water conditions.

U.S. Pat. No. 6,349,413 issued to Rose et al. discloses a trouser or shirt having removable appendage portions.

As indicated above, a myriad of weighted exercise garments exist in the prior art. However, none of the conventional weighted garments are configurable to allow the wearer to target a specific muscle group or to comport with ambient weather conditions. Furthermore, weights placed within pockets are easily shifted or dislodged; the weighted pockets also engage and irritate the wearer's skin unless an undergarment is worn, which is stifling and uncomfortable.

The present invention overcomes the disadvantages of the prior art weighted garments by providing a vest and accompanying shorts that are worn either as a unitary garment or independently, as desired. The shorts and vest each have separable flaps that restrain weights within designated pockets, and which provide a comfortable barrier between the weights and the wearer. The vest includes a detachable torso and sleeve extensions while the shorts include detachable leg extensions allowing the wearer to vary the garment's configuration according to an ambient temperature, a desired level and location of resistance or a preferred style.

SUMMARY OF THE INVENTION

The present invention relates to an exercise garment formed of a pair of shorts and an accompanying vest which are worn by an exerciser to enhance strength, conditioning, power, endurance and agility. The shorts include a pelvic portion with a pair of leg sections depending therefrom. Each leg section terminates at a leg opening having a circumferential zipper strand adjacent thereto. Immediately above the zipper strand are a plurality of juxtaposed, segregated pockets for receiving a weighted bar. A leg extension having multiple weight pockets includes a peripheral zipper strand at an upper end for mating engagement with the zipper strand of either leg section allowing the effective length thereof to be increased. The accompanying vest is formed of a torso portion with a pair of separable sleeves extending therefrom. A plurality of weight pockets are positioned on the front and rear of the torso portion as well as each sleeve. A torso extension having multiple weight pockets is removably attachable to the lower edge of the torso portion. Comfort flaps are securable over all of the pockets to form a comfort-enhancing, weight-restraining barrier.

It is therefore an object of the present invention to provide an exercise garment that allows a wearer to enhance a given exercise routine.

It is another object of the present invention to provide an exercise garment having detachable sections that allow the wearer to selectively vary the garment style.

It is yet another object of the present invention to provide an exercise garment having detachable sections that allow a wearer to isolate a load to certain areas of the body.

It is yet even another object of the present invention to provide an exercise garment having detachable sections that allow a user to configure the garment according to ambient conditions.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
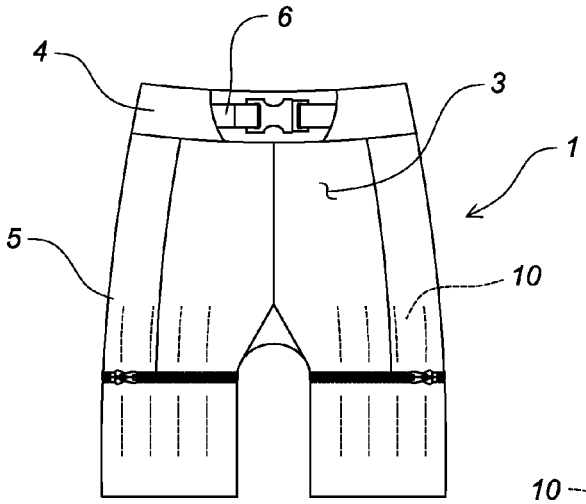
FIG. 1 is a front, plan view of the shorts.
Figure 2:
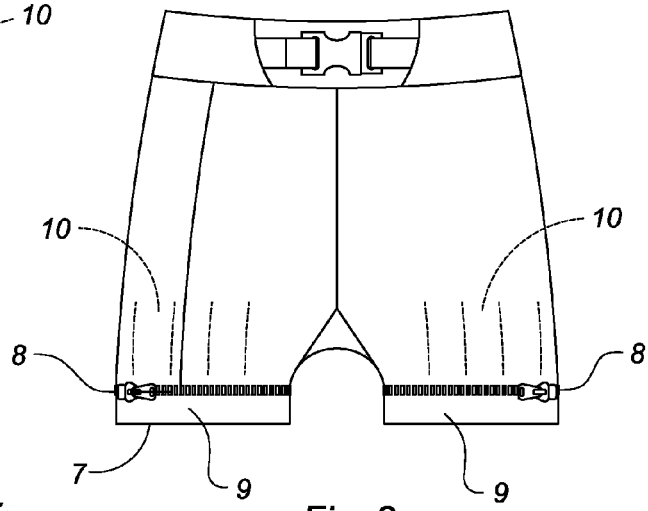
FIG. 2 depicts the shorts of FIG. 1 with the leg extensions removed.
Figure 3:
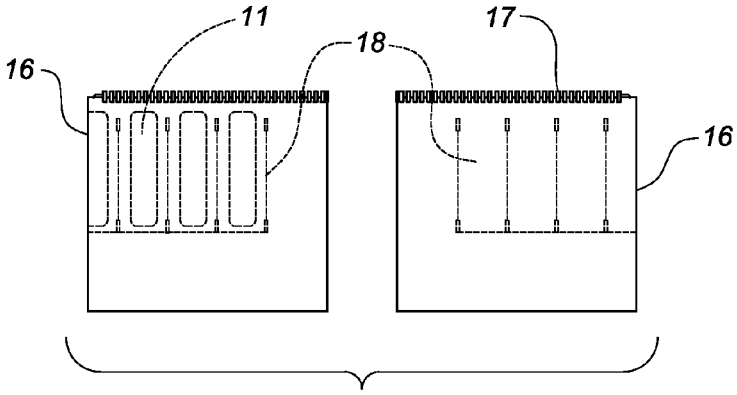
FIG. 3 is an isolated view of the leg extensions.

The present invention relates to an exercise garment formed of a pair of shorts 1 and an accompanying vest 2 for use with certain physical activities to enhance strength, conditioning, power, endurance and agility. The shorts include a pelvic portion 3 having a waistband 4 at an upper end and a pair of leg sections 5 depending from a lower end. An adjustable belt 6 is received within the waistband section for securing the shorts about a wearer's waistline. Each leg section terminates at a leg opening 7 having a circumferential zipper strand 8 adjacent thereto. The zipper strand 8 is fastened to the exterior surface of the leg section, at a minimal distance from the leg opening, to form a protective panel 9 that prevents the zipper strand from contacting, and possibly irritating the wearer's leg. A plurality of juxtaposed, segregated pockets 10 are positioned on the interior surface of each leg section. Each pocket is dimensioned and configured to receive a single, elongated weighted cylinder or bar 11. Preferably, the pockets are arranged in groups each having a predetermined number of pockets according to location, garment size, etc.

Figure 4:
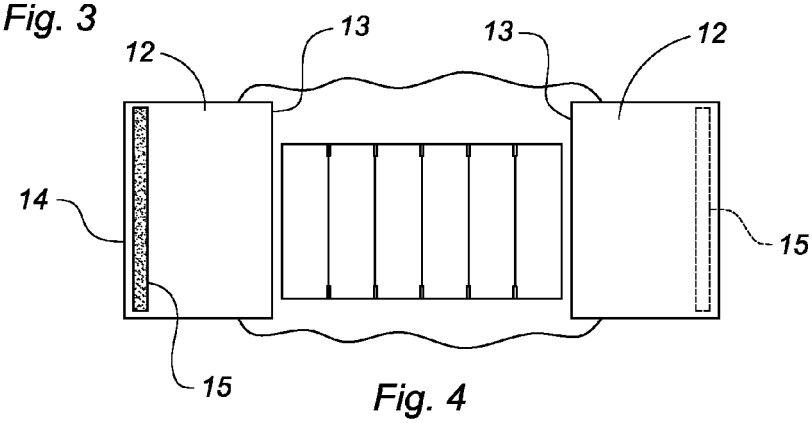
FIG. 4 depicts exemplary weight pockets which are disposed on either of the legs or leg extensions.
Figure 5:
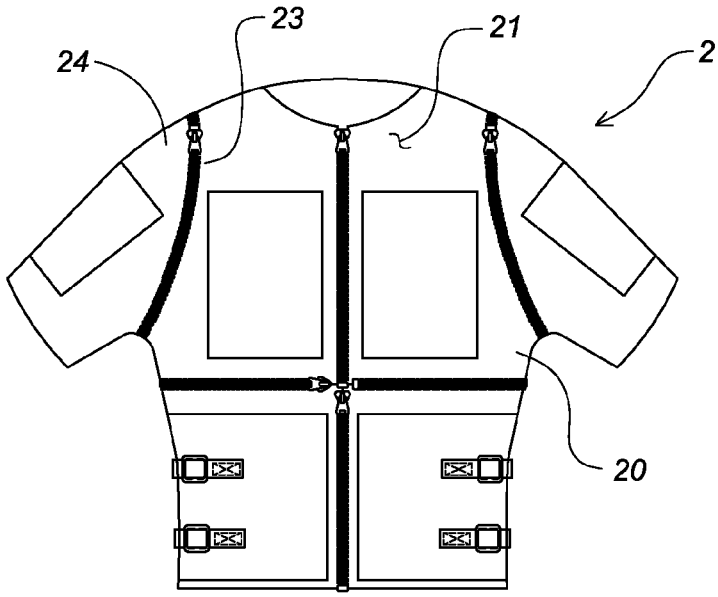
FIG. 5 is a front, plan view of the vest according to the present invention.
Figure 7:
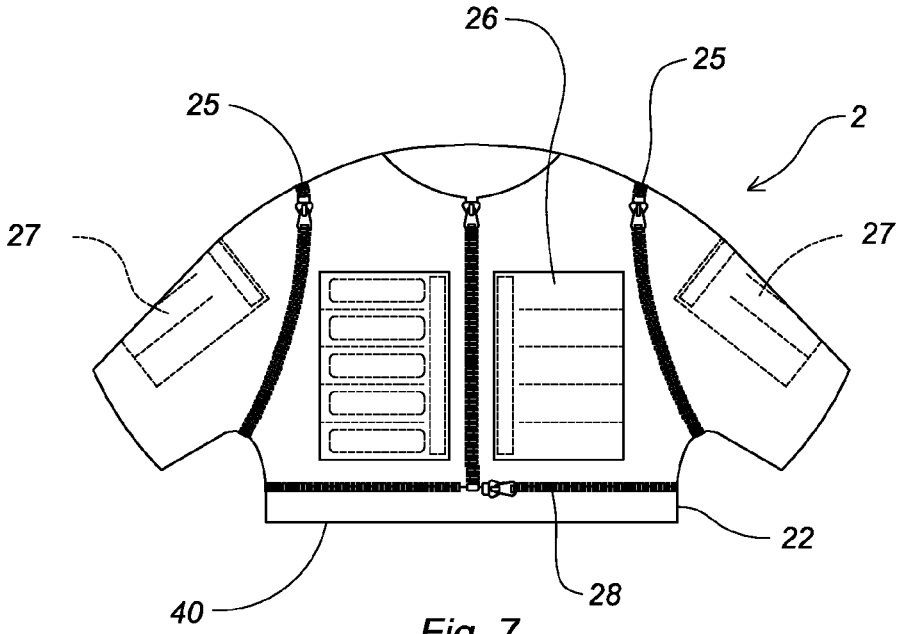
FIG. 7 depicts the vest with the torso extension removed.
Figure 6:
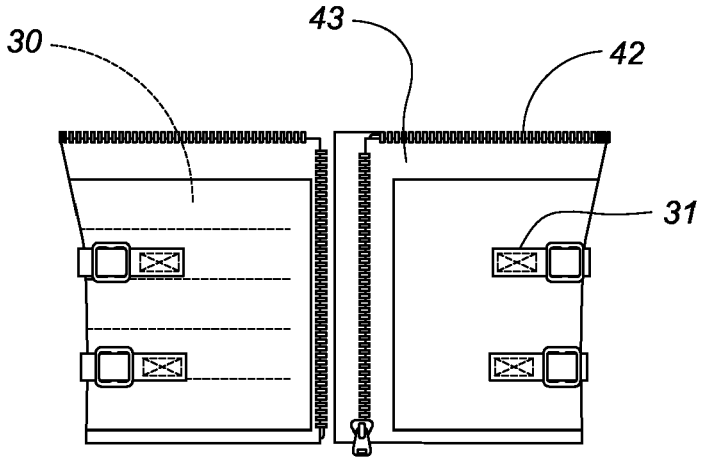
FIG. 6 is an isolated view of the torso extension.

Now specifically referring to FIG. 4, each pocket includes at least one open end that allows insertion and removal of the weight. The pockets are positioned vertically so as to be parallel to the longitudinal leg bones. A pair of comfort flaps 12 are attached to the interior surface of each leg section that may be joined to form a protective barrier between a group of pockets and the wearer's skin. Each flap includes a first end 13 that is fastened to the leg section, adjacent to one side of the juxtaposed pockets, and an opposing free end 14 having a hook and loop fastener 15 thereon for mating engagement with the fastener on the other flap. Once the desired number of weights are placed within the pockets, the flaps are joined to prevent the weighted pockets from impacting and potentially irritating the wearer's skin.

The shorts may be supplemented with a pair of leg extensions 16 to further exert the legs and which can be removed if ambient conditions dictate. Each leg extension includes a peripheral zipper strand 17 at an upper end for mating engagement with the zipper strand 8 of either leg section allowing the effective length thereof to be extended. Each leg extension also includes a plurality of vertical pockets 18 for receiving weights 11, and associated comfort flaps, as described, supra.

The accompanying vest 2 may be used separately from or in conjunction with the shorts for a given exercise. The vest includes a torso portion 20 having a front 21, a rear, a lower edge 22 and a pair of arm openings 23. A pair of sleeves 24 are removably joined to the torso portion with mating zipper strands 25; the strand on the torso portion has an associated protective panel as described, supra. When the sleeves are removed from the vest, the vest is completely sleeveless. On the interior surfaces of both the front and rear are multiple juxtaposed pockets 26 for receiving weights allowing the wearer to selectively weight load either the front or rear torso. A first pocket is positioned on the interior surface of the front portion and a second pocket is positioned on the interior surface of the rear portion. Third and fourth pockets 27 are likewise disposed on the interior surface of each sleeve. Unlike the shorts, the vest pockets are preferably horizontal.

A peripheral zipper 28 at the lower edge of the torso portion is also spaced a predetermined distance therefrom to form a protective flap 40; the strand is attachable to a similar zipper strand 42 on an upper edge of a torso extension 43. The torso extension includes multiple weight-receiving pockets 30 on front and rear portions and adjustment straps 31 for adjustably securing the extension about a wearer. Comfort flaps of the type described above are removably positioned over each of the weight pockets to retain the weights therein. The detachable comfort flaps as described supra completely overlay the pockets to prevent the weight from contacting and potentially irritating a wearer's skin.

The above-described device is not limited to the exact details of construction and enumeration of parts provided herein. For example, the garment is preferably constructed with a neoprene fabric and/or the material currently marketed and sold under the trademark LYCRA®. The material allows the garment to be easily worn indoors, outdoors and underwater while creating a heat retention barrier for encapsulated muscles. However, the size, shape and materials of construction of the various components can be varied.

Figure 8:
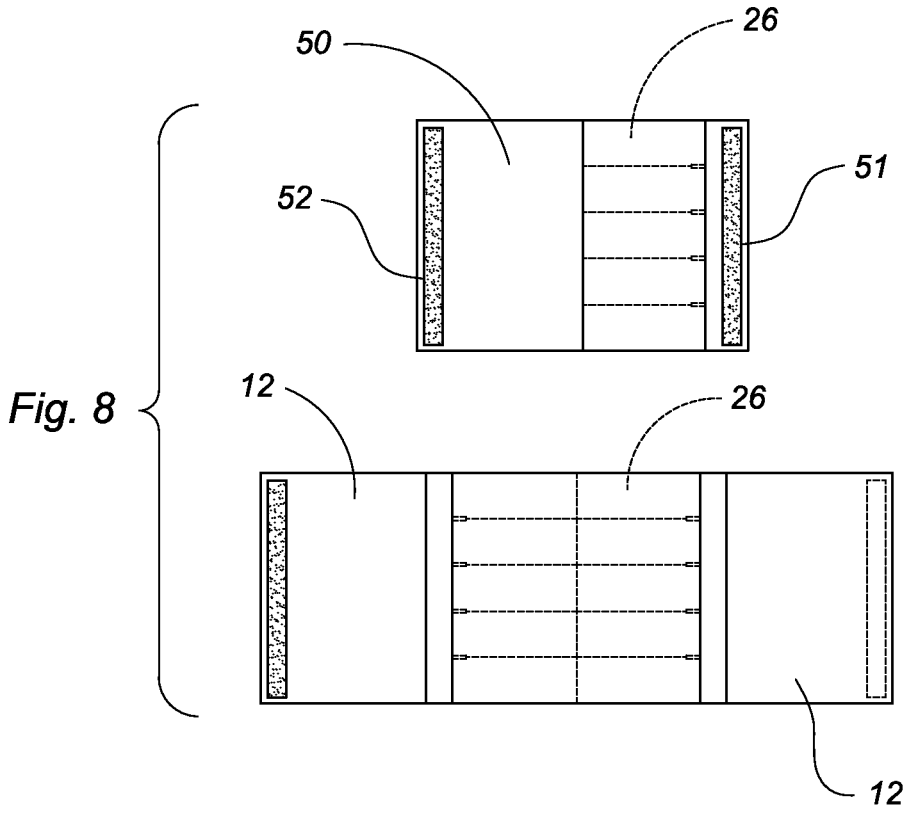
FIG. 8 is an isolated, detailed view of exemplary groups of weight pockets.

In addition, the pockets are arranged into groups with each group positioned on a designated part of the garment. The number of pockets within each group can be varied according to the designated body area to be loaded, the size of the garment, the type of wearer, etc. As depicted in FIG. 8, some groups may contain five pockets while others contain ten though the number can be varied. The groups containing fewer pockets may only require a single flap 50 having a fastener 52 on a free edge that mates with a similar fastener 51 adjacent to the group of pockets.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An exercise vest comprising:

a front portion, a rear portion, a torso extension having a lower edge, a lower edge and a pair of arm openings, said front portion, said rear portion and said torso extension each having an interior surface and an exterior surface;

a pair of sleeves each having an upper end, an exterior surface and an interior surface;

means for removably securing the upper end of each of said sleeves to one of said arm openings;

wherein, when said sleeves are removed from said exercise vest, the vest is completely sleeveless;

a first pocket positioned on the interior surface of said front portion;

a second pocket positioned on the interior surface of said rear portion;

wherein said torso extension has at least one pocket positioned on the interior surface; means for removably joining said torso extension to the lower edge of said torso portion a weight removably received within said first pocket and said second pocket and said at least one pocket on said torso extension to weight select portions of a wearer's upper body.

2. The garment according to claim 1 further comprising:

a detachable comfort flap completely overlaying said pocket to prevent said weight from contacting and potentially irritating a wearer's skin.

3. The garment according to claim 2 wherein said means for removably securing the upper end of each of said sleeves to one of said arm openings comprises:

a first zipper strand attached to the exterior surface of said torso portion and spaced a minimal distance from said arm opening to form a protective panel that prevents the zipper strand from contacting and irritating the wearer's arm;

a mating zipper strand circumferentially attached to the upper end of said sleeve.

4. The garment according to claim 1 wherein said means for removably joining said torso extension to the lower edge of said torso portion comprises:

a zipper strand circumferentially attached to said torso portion and spaced a predetermined distance from the lower edge thereof to form a protective flap;

a second mating zipper strand circumferentially attached to the upper edge of the torso extension.

5. The garment according to claim 4 wherein said torso extension includes an adjustment strap for adjustably securing the extension about a wearer.

6. The exercise vest according to claim 1 further comprising a third pocket positioned on the interior surface of one of said sleeves;

a fourth pocket positioned on the interior surface of another of said sleeves;

a weight removably positioned within each of said sleeves to weight said arms when performing an exercise.

7. The vest according to claim 6 wherein said first pocket, said second pocket, said third pocket and said fourth pocket each include a pair of comfort flaps adjacent thereto, each of said flaps having a mating fastener at a free end thereof for joining the flaps to form a protective barrier between said weight and a wearer's skin.

* * * * *